US005201849A

United States Patent [19]

Chambers et al.

[11] Patent Number: 5,201,849

[45] Date of Patent: Apr. 13, 1993

[54] TURBINE ROTOR SEAL BODY

[75] Inventors: Stephen M. Chambers, Cincinnati; Richard L. Stanley, Loveland, both of Ohio; Robert R. Bittle, Ames, Iowa

[73] Assignee: General Electric Company, Cincinnati, Ohio

[21] Appl. No.: 639,842

[22] Filed: Dec. 10, 1990

[51] Int. Cl.[5] ..... F01D 5/08

[52] U.S. Cl. ..... 416/95; 416/220 R

[58] Field of Search ..... 416/95, 96 R, 190, 193 A, 416/219 R, 220 R, 500

[56] References Cited

U.S. PATENT DOCUMENTS

| | | | |
|---|---|---|---|
| 3,112,915 | 12/1963 | Morris | 416/220 R |
| 3,266,770 | 8/1966 | Harlow . | |
| 3,318,573 | 5/1967 | Matsuki et al. | 416/95 |
| 3,610,778 | 10/1971 | Suter | 416/500 |
| 3,709,631 | 1/1973 | Karstensen et al. . | |
| 3,751,183 | 8/1973 | Nichols et al. . | |
| 3,791,758 | 2/1974 | Jenkinson | 416/95 |
| 3,834,831 | 9/1974 | Mitchell | 416/95 |
| 3,887,298 | 6/1975 | Hess et al. | 416/95 |
| 4,047,837 | 9/1977 | Hueber et al. | 416/95 |
| 4,101,245 | 7/1978 | Hess et al. . | |
| 4,280,795 | 7/1981 | Trousdell . | |
| 4,343,594 | 8/1982 | Perry . | |
| 4,344,740 | 8/1982 | Trenschel et al. . | |
| 4,422,827 | 12/1983 | Buxe et al. . | |
| 4,457,668 | 7/1984 | Hallinger . | |
| 4,505,642 | 3/1985 | Hill . | |
| 4,523,890 | 6/1985 | Thompson . | |
| 4,536,129 | 8/1985 | Jankot . | |
| 4,659,285 | 4/1987 | Kalogeros et al. | 416/95 |
| 4,743,164 | 5/1988 | Kalogeros . | |
| 4,743,166 | 5/1988 | Elston, III et al. . | |
| 4,854,821 | 8/1989 | Kernon et al. . | |
| 4,872,810 | 10/1989 | Brown et al. . | |

*Primary Examiner*—Edward K. Look
*Assistant Examiner*—James A. Larson
*Attorney, Agent, or Firm*—Jerome C. Squillaro; James P. Davidson

[57] ABSTRACT

A method and apparatus for reducing thermal distress and creep of a disk post in a gas turbine engine, the disk post being defined between an adjacent pair of blade roots of a respective pair of turbine blades in a turbine disk. The blade roots extend radially outward of the turbine disk and each terminate in a blade platform to form a cavity above the disk post. A seal generally covers the cavity for preventing a flow of combustion gases over the disk post. The seal includes axial segments defining a channel over a radially outer surface of the disk post. A flow of insulative air is directed into the channel defined over the disk post and diffused to reduce its velocity. The insulative air effectively reduces heat transferred from the blade platforms and combustion gases to the disk post.

5 Claims, 3 Drawing Sheets

TURBINE ROTOR SEAL BODY

The present invention relates to gas turbine engines and, more particularly, to a method and apparatus for reducing thermal distress and creep of a turbine rotor disk post.

BACKGROUND OF THE INVENTION

In turbomachinery rotor assemblies such as gas turbine engines, a plurality of blades extend radially from a rotor wheel or disk. Each of the blades includes an airfoil section and a root portion for attaching the blade to the rotor disk. A platform separates the airfoil section from the root portion. A plurality of slots is formed in the rotor disk for receiving the root portion of the blade. Each of the root portions generally includes a shank which connects the portion fitting into the slot in the rotor disk to the blade platform. The extension of the shank from the root portion and the blade platform of adjacent blades normally defines a small cavity above the rotor disk. An adjacent pair of slots likewise defines a disk post between an adjacent pair of root portions of the blades. A seal is generally required to block the flow of combustion gases over the top of the rotor disk through the cavity defined between the shank portions of adjacent blades. The flow of combustion gases through this cavity reduces engine efficiency since it represents a loss of combustion gases through the airfoil section of the blades and, more significantly, such combustion gases may thermally damage the rotor disk. The seals utilized to block combustion gas flow through the cavity over the rotor disk have also included a damper to reduce vibration.

U.S. Pat. No. 3,751,183, assigned to the assignee of the present application, discloses a rotor assembly which includes a combined seal and damper assembly comprising a pair of axially spaced end plates interconnected by an axially extending connecting member. The forward end plate closes the cavity between adjacent blade shanks while the connecting member is adapted to receive one or more damper weights which are adjustably secured to the connecting member in a position where they will bear against the underside of adjacent blade platforms to provide a desired damping. The forward end plate generally seals the interblade cavity along the platform surface and adjacent the blade shanks. However, there is generally provided some clearance at the aft end of the cavity such that any gases entering into the cavity can flow out around an aft seal plate. Even though the seal plate is designed so as to generally seal the cavity, some leakage of the hot combustion gases into the cavity occurs. Still further, heat transfer from radiation from the hot blade platforms also introduces additional heat into the top of the disk post. The combined leakage of hot gases and the radiated heat may sometimes result in excessive thermal distress of the disk post and reduction in creep life of the turbine disk. In general, gas temperatures within the underplatform cavity without forced circulation may be in excess of 1500° F. in a first stage turbine blade rotor assembly.

One attempt to alleviate the possibility of thermal distress on the turbine disk post is shown in U.S. Pat. No. 4,457,668. This device, rather than seal the cavity as described above, purges the cavity with air flowing up the front face of the disk. The device is essentially a scoop which channels the air over the top of the disk post. The device also acts as a vibration damper. Since the whole cavity is purged, considerable amounts of air may have to be used. Also, since the air must be at a higher pressure than the combustion gases, the air may actually be hotter than the disk and its heat transfer coefficient relatively high, heat input to the disk from the air is a possibility. The device is described as being close fitting to the blade and platform and, in effect, avoids sealing the forward end of the cavity and relying on the aft end opening to control the amount of air used.

SUMMARY OF THE INVENTION

It is an object of the present invention to provide a method and apparatus for reducing the possibility of thermal distress on turbine disk posts in turbomachinery.

It is another object of the present invention to provide a method and apparatus for reducing the possibility of thermal distress on turbine disk posts and turbomachinery by creating an insulative air layer over a radially outer surface of a turbine disk post.

The above and other objects, features, and advantages of the present invention are achieved in a system in which a pair of axially displaced end plates are interconnected by a connecting member and positioned in a cavity defined along a radially outer surface of a turbine disk post between an adjacent pair of turbine blade shanks. A forward one of the end plates is provided with a small aperture to allow a controlled amount of air flow into the cavity above the rotor disk post. The connecting member includes a pair of spaced members extending along the top of the disk post to define a channel into which the air entering the aperture is directed. The aperture extends through the forward plate into a diffuser which reduces the air velocity so as to allow an insulative layer of low velocity air to be formed over the disk post. A low velocity flow of air maintains the heat transfer coefficient between the air and the upper surface of the disk post at a relatively low value since air with a higher velocity would have a higher heat transfer coefficient. The channel forming members also provide physical line of sight isolation between the platform and the disk post to provide further insulation and reduce heat transfer by radiation from the blade platforms.

BRIEF DESCRIPTION OF THE DRAWINGS

For a better understanding of the present invention, reference may be had to the following detailed description taken in conjunction with the accompanying drawings in which.

DETAILED DESCRIPTION OF THE PREFERRED EMBODIMENT

Figure 1:
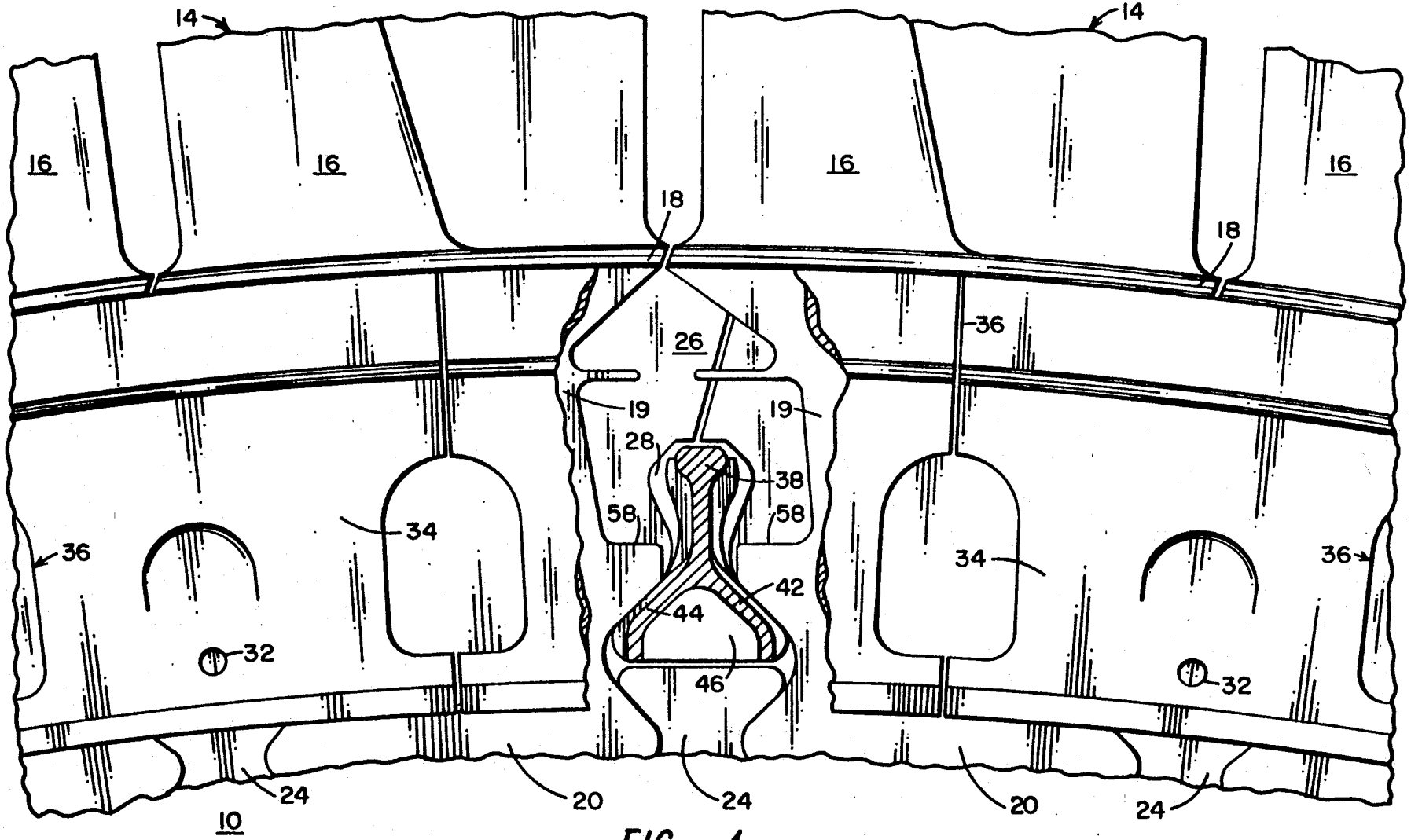
FIG. 1 is a partial cross-section, elevational view of a turbomachinery rotor assembly incorporating a seal body in accordance with the present invention.
Figure 2:
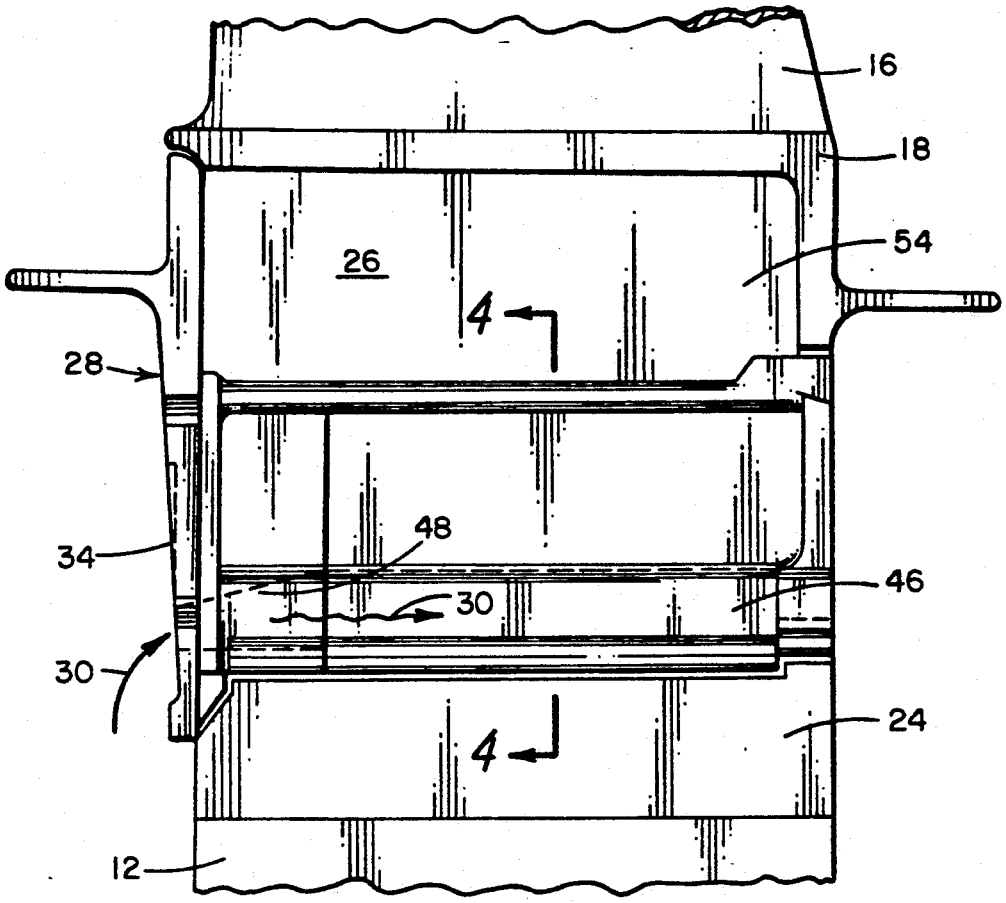
FIG. 2 is a partial cross-sectional view of the seal body of FIG. 1 taken parallel to the axis of turbine rotor.

Turning first to the turbomachinery rotor assembly illustrated in FIGS. 1 and 2, the assembly 10 includes a rotor wheel or disk 12 which carries a plurality of radially extending blades 14. Each blade 14 includes an airfoil section 16, a platform section 18, a shank section 19, and a root portion 20. The rotor disk 12 is formed with a plurality of axially extending slots designed to cooperatively mate with the root portions 20 of each of the blades 14. In the illustrative embodiment, the slots and root portions are formed to have a characteristic fir tree shape although other forms of locking root portions and slots of types well known in the art may be utilized. The slots are uniformly circumferentially spaced about the rotor disk 12 so that when the blades 14 are positioned in their assembled orientation, each of the platform sections 18 abuts with adjacent platform sections 18 to form a substantially continuous annular inner boundary for the motive fluid flowing across the blade airfoil sections 16. A seal (not shown) extends underneath each blade platform at the abutting joint to seal the underplatform cavity.

Each adjacent pair of rotor disk slots defines a disk post 24 between the slots. Furthermore, each adjacent pair of blade shank sections 19 in conjunction with the blade platform section 18 and a top surface of the disk post 24 define a cavity 26 into which a seal body assembly 28 is positioned for retarding the leakage of combustion gases axially across the disk post in the area of the blade shank sections 19. The seal body assembly 28 may also include damping means (not shown) to assist in damping vibration as is illustrated in the aforementioned U.S. Pat. No. 3,751,183.

Figure 4:
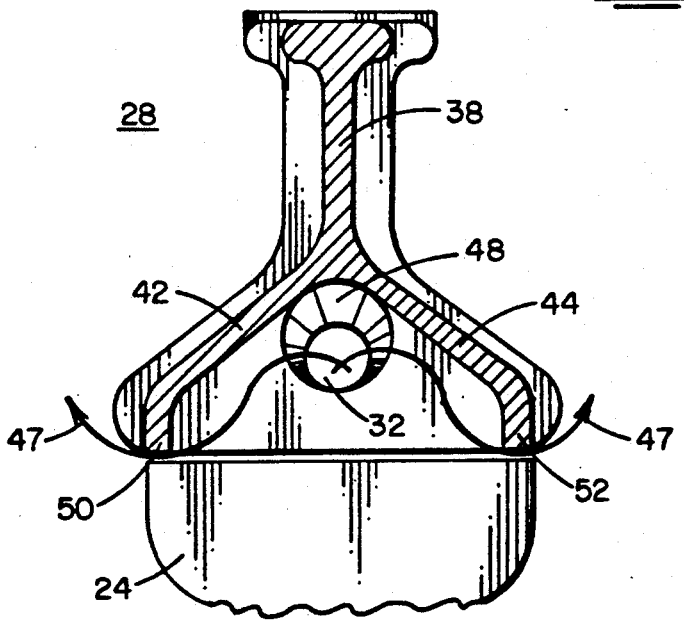
FIG. 4 is a cross-section taken along lines 4—4 of FIG. 2 with the forward end plate omitted.
Figure 3:
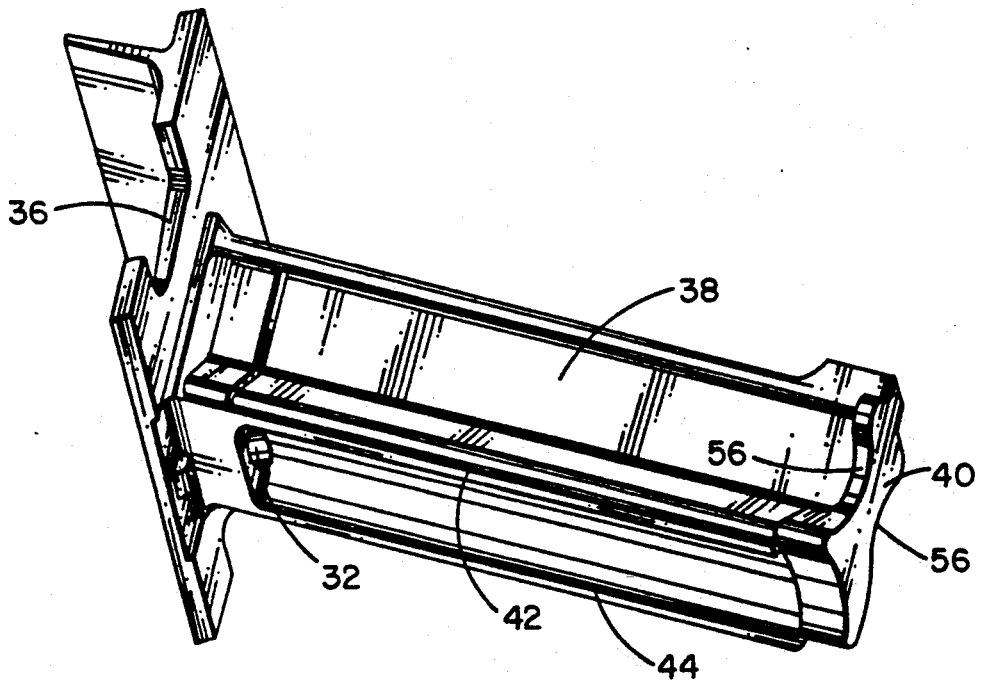
FIG. 3 is a perspective view of a seal body assembly in accordance with the present invention.

Even though the cavity 26 is designed to be sealed, some leakage of the hot combustion gases around the blade platform sections 18 occurs so that the gases enter into the cavity and may contribute to convective heating of the rotor disk post 24. In addition, heat conduction from adjacent hardware elements and radiation from the blade platform sections 18 into the cavity 26 also contribute to a significant heat input into the disk post. The present invention reduces the heat transfer to the turbine disk post and reduces the disk post temperature by providing a heat blocking shield and a low velocity air insulation layer between the disk post and blade platform. An aperture 32 is formed in the front face 34 of a forward end plate 36 of the cavity seal body assembly 28. The aperture 32 is sized and opens into a diffusing section to provide a controlled amount of air and a velocity reduction as the air enters into the cavity 26 to establish an insulative layer of low velocity air at the top of the turbine disk post 24. The air is extracted from a high pressure compressor discharge upstream of the engine combustion stage and is generally at a higher pressure than the combustion gases entering the first stage turbine blades. The temperature of this compressor discharge air is generally hotter than the temperature of the first stage turbine disk. As shown in FIG. 2, in the perspective view of FIG. 3, and in the cross-sectional view of FIG. 4, the seal body assembly comprises a connecting member 38 between opposite end plates 36 and 40. The connecting member 38, in a preferred embodiment, comprises a trinary beam having three axially extending segments joined along a line extending axially generally through the center of the beam. The two radially inward segments form a pair of opposed legs 42, 44 which extend down to opposite sides of the disk post 24 so as to form a channel 46 along the top of the disk post. The air indicated by arrows 30 entering the aperture 32 in the forward end plate 36 flows into the channel 46 along the top of the disk post 24. The air indicated by arrow 30 is preferably supplied from an upstream high pressure compressor discharge at a higher pressure than the working fluid or combustion gases impinging on the blade airfoil sections 16 and may be hotter than the disk post temperature but is cooler than the blade platform temperature and the temperature of leakage gases in the interblade cavity. The space above the legs 42, 44 and below the blade platform sections 18 in which hot combustion gases may infiltrate is isolated from the channel 46 by the legs 42, 44 which thus insulate the channel air and block heat radiated from the platform sections 18. The aperture 32 in the forward end plate 36 opens into a diffusing hole 48 which reduces the velocity of the air entering the aperture 32 and thereby maintains the heat transfer coefficient between the channel air and the disk post upper surface at a relatively low value. The legs 42, 44 of the connecting member 38 are machined such that the clearance between their respective distal ends 50, 52 and an adjacent disk post 24 is relatively small to establish a controlled degree of air leakage around the ends 50, 52.

The flow of air into the channel 46 significantly reduces the temperature of the seal body forward end plate 36 and the adjacent retainer (not shown) for the seal body assembly 28. The air passing over the top of the disk post 24 is effectively an insulating barrier which provides protection from the hotter underplatform cavity 54 above the legs 42, 44 and reduces the heat transfer into the disk post 24. Some of the air in the channel 46 flows around the ends 50, 52 of the legs 42, 44, as indicated by arrows 47, and into the cavity 54 above the legs and below the platform sections 18 so as to help to reduce the temperature in that cavity. Other air flows to the end of the channel 46 and exits about the aft end plate 40. The flow of air into the underplatform cavity 54 from the reduced velocity air in the channel 46 increases the pressure in the underplatform cavity in such a manner as to provide increased protection from ingestion of combustion gases into the cavity 54.

Each of the seal body assemblies 28 includes spaced axially facing end plates 36, 40 which are interconnected by an axially extending connecting member 38. The connecting member 38 includes a pair of depending leg portions 42, 44 defining a channel 46 extending axially above a turbine disk post 24. The seal body assembly 28 may also include one or more dovetails 56 or be provided with suitable shaped retention means for engaging a locking slot cooperatively defined by one or more axial corrugations 58 projecting from the shank sections 19 of peripherally adjacent blades 14 in an area radially outward of the turbine rotor disk 12. The locking slot is sized so as to engage the dovetails or retention means and lock the seal body assembly to its adjacent blade shanks. Each of the connecting members 38 may include a damper means (not shown) which is movably secured to the connecting member and shaped and positioned such that when the seal body assembly 28 is installed as indicated in FIGS. 1 and 2, the urging of centrifugal force will cause the damper means to move radially outward and contact the underside of the adjacent blade platform sections 18. A more detailed description of the utilization of damper means may be had by reference to the aforementioned U.S. Pat. No. 3,751,183.

The end plates 36, 40, the connecting member 38, and the retaining members or dovetails 56 may be conveniently formed as an integral cast member or may be formed separately and welded or otherwise connected to form the seal body assembly 28. The invention as described herein may require machining of the aperture and diffusion hole in order to provide the controlled flow of cooling air into the channel 46 defined by the opposing legs 42, 44 of the connecting member 38. The aperture 32 may have a diameter of about 0.075 inches in a first stage turbine disk and the diffuser opening 48 may be about three times the aperture diameter. The air flow into the channel 46 may be about 0.2 percent of the total mass flow through the core engine.

It will be appreciated that what has been described is a seal body assembly 28 for reducing thermal distress and creep of a disk post 24 in a gas turbine engine. In general, the invention comprises a method and apparatus for directing a controlled flow of insulating air into a channel 46 defined over the disk post 24 with the insulating air being diffused so as to effectively reduce its velocity in order to maintain its heat transfer coefficient at a relatively low level so as to minimize the heat transferred to the top surface of the disk post 24. The invention further includes a method and apparatus for separating hotter, under platform gases from the top of a disk post and for blocking radiated heat from the platform to the disk post. The method and apparatus significantly reduces the volume of air required to maintain disk post temperature within desirable limits. The invention has been found to reduce the internal disk post temperature by about 44° F. at an area where mechanical blade loads are reacted. The air temperature within channel 46 may be in the order of 1300° F. or in excess of 200° F. cooler than the temperature of leakage gases in prior art systems. While the heat transfer coefficient of moving gases is higher than that of stagnate gas, the significant difference in temperature reduces the actual heat transferred into the disk post. Higher air velocity which could be attained without diffusing would result in higher heat transfer coefficients and more heat input into the disk post.

While the invention has been described in what is presently considered to be a preferred embodiment, other modifications and variations will become apparent to those skilled in the art. Accordingly, it is intended that the invention not be limited to the specific disclosed embodiment but be interpreted within the spirit and scope of the appended claims.

What is claimed is:

1. Apparatus for thermal protection of a disk post in a gas turbine engine, the disk post being defined by adjacent slots in a turbine rotor disk, each of the slots being adapted for receiving a root portion of a turbine rotor blade, each blade having a shank extending radially outward from the root portion and a platform atop the shank, the apparatus comprising:

(a) a first end plate sized for generally covering a forward end of an opening above a respective disk post, the opening being defined by a top of the disk post, the shanks of the rotor blades on each side of the disk post and the platforms atop the shanks;

(b) a second end plate positioned generally within an aft end of the opening;

(c) a connecting member extending between the first and second end plates for maintaining a preselected orientation and spacing of the end plates, the connecting member including first and second legs extending therefrom and defining a channel over the top of the disk post; and (d) an aperture formed in the first end plate and opening into the channel for admitting a controlled flow of air axially into the channel for providing an insulative layer of air over the top of and in direct contact with the disk post; and wherein each of said first and second legs include distal ends which are sized such that a clearance between each of said distal ends and said top of the disk post establishes a controlled degree of air leakage around each of said distal ends for reducing a temperature in a portion of said opening located radially outward from said channel and for increasing a pressure in said portion of said opening, thereby providing increased protection from ingestion of combustion gasses into said portion of said opening.

2. Apparatus for thermal protection of a disk post in a gas turbine engine, the disk post being defined by adjacent slots in a turbine rotor disk, each of the slots being adapted for receiving a root portion of a turbine rotor blade, each blade having a shank extending radially outward from the root portion and a platform atop the shank, the apparatus comprising;

(a) a first end plate sized for generally covering a forward end of an opening above a respective disk post, the opening being defined by a top of the disk post, the shanks of the rotor blades on each side of the disk post and the platforms atop the shanks;

(b) a second end plate positioned generally within an aft end of the opening;

(c) a connecting member extending between the first and second end plates for maintaining a preselected orientation and spacing of the end plates, the connecting member including first and second legs extending therefrom and defining a channel over the top of the disk post;

(d) an aperture formed in the first end plate and opening into the channel for admitting a controlled flow of air axially into the channel for providing an insulative layer of air over the top of and in direct contact with the disk post; and (e) a diffuser formed in the first end plate and extending into at least part of the connecting member, the aperture in the first end plate forming an entrance into the diffuser, the diffuser reducing air velocity over the disk post top for establishing a relatively low heat transfer coefficient between the air and the disk post.

3. The apparatus of claim 2, wherein each of said first and second legs include distal ends which are sized such that a clearance between each of said distal ends and said top of the disk post establishes a controlled degree of air leakage around each of said distal ends for reducing a temperature in a portion of said opening located radially outward from said channel and for increasing a pressure in said portion of said opening, thereby providing increased protection from ingestion of combustion gases into said portion of said opening.

4. A method for reducing a thermal distress and creep of a disk post in a gas turbine engine, the disk post being defined between an adjacent pair of blade roots of a respective pair of turbine blades in a turbine disk, the blade roots extending radially outward of the turbine disk and each terminating in a blade platform to form a cavity above the disk post, seal means generally covering the cavity for preventing a flow of combustion gasses over the disk post, the seal means including means defining a channel over a radially outer surface of the disk post, the method comprising the steps of:

(a) directing an axial flow of insulative air into the channel defined over the disk post;

(b) diffusing the flow of insulative air for reducing the velocity thereof and maintaining the heat transfer coefficient of the insulative air at a relatively low level; and (c) leaking a controlled flow of air out of the channel and into a portion of the cavity located above the channel for reducing a temperature in the portion of the cavity and providing increased protection against ingestion of combustion gasses into the portion of the cavity.

5. The method of claim 4, wherein the temperature of said air flow admitted into the channel is less than the temperature of the platform and any gases leaking through said sealing means.

* * * * *